US011359487B2

(12) United States Patent
Ray et al.

(10) Patent No.: US 11,359,487 B2
(45) Date of Patent: Jun. 14, 2022

(54) SELECTION OF FLUID SYSTEMS BASED ON WELL FRICTION CHARACTERISTICS

(71) Applicant: Halliburton Energy Services, Inc., Houston, TX (US)

(72) Inventors: Baidurja Ray, Houston, TX (US); Dinesh Ananda Shetty, Sugarland, TX (US); Aaron Gene Russell, Humble, TX (US); Mikko Jaaskelainen, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 127 days.

(21) Appl. No.: 16/675,512

(22) Filed: Nov. 6, 2019

(65) Prior Publication Data

US 2021/0131280 A1 May 6, 2021

(51) Int. Cl.

| | |
|---|---|
| ***E21B 49/00*** | (2006.01) |
| ***E21B 49/08*** | (2006.01) |
| *E21B 43/26* | (2006.01) |

(52) U.S. Cl.

CPC ..... *E21B 49/008* (2013.01); *E21B 49/088* (2013.01); *E21B 43/261* (2013.01); *E21B 49/0875* (2020.05)

(58) Field of Classification Search

CPC .. E21B 49/008; E21B 49/088; E21B 49/0875; E21B 43/261; E21B 47/06; E21B 43/26

See application file for complete search history.

(56) References Cited

PUBLICATIONS

Harris et al., High-Rate Foam Fracturing: Fluid Friction and Perforation Erosion, Feb. 2000, SPE Prod. & Facilities 15(1), pp. 27-32 (Year: 2000).*

One Petro Search Results, Apr. 18, 2021, 10 pp. (Year: 2021).*

Dodge, D.W., et al., "Turbulent Flow of Non-Newtonian Systems," A.I.Ch.E. Journal, vol. 5, No. 2, Jun. 1959, pp. 189-204.

Hartnett, J. P., et al., "Prediction of Friction and Heat Transfer for Viscoelastic Fluids in Turbulent Pipe Flow," International Journal of Thermophysics, vol. 7, No. 1, 1986, pp. 53-63.

Szilas, A. P., et al., "Determination of turbulent pressure loss of non-newtonian oil flow in rough pipes," Rheologica Acta, vol. 20, No. 5, Feb. 9, 1981, pp. 487-496, Petroleum Engineering Department, Technical University for Heavy Industries, Hungary.

Ye, A., et al., "Field Trial Evaluation on a Hydrocarbon-Free Friction Reducer," American Association of Drilling Engineers, AADE-14-FTCE-34, 2014, 5 pages.

* cited by examiner

*Primary Examiner* — Toan M Le

(74) *Attorney, Agent, or Firm* — John W. Wustenberg; Parker Justiss, P.C.

(57) ABSTRACT

A wellbore fracturing system that includes wellbore fracturing resources coupled through a wellbore conveyance to a subterranean formation of the wellbore; The wellbore fracturing system further includes a bottom hole pressure gauge that provides a bottom hole gauge pressure, and a processor coupled to the wellbore fracturing resources and the wellbore conveyance that calculates a wellbore friction pressure using a time-series sampling of bottom-hole gauge pressures for a fracturing fluid system after a uniform fracturing fluid condition is achieved in the wellbore. Also included are methods of calculating and managing a wellbore friction pressure.

21 Claims, 5 Drawing Sheets

SELECTION OF FLUID SYSTEMS BASED ON WELL FRICTION CHARACTERISTICS

TECHNICAL FIELD

This application is directed, in general, to fracturing of a hydrocarbon wellbore and, more specifically, to a wellbore fracturing system, a method of calculating a friction pressure (CALCFP) in a wellbore and a method of managing a friction pressure in a wellbore.

BACKGROUND

Hydraulic fracturing or "fracking" is a type of subsurface well stimulation, whereby formation fluid removal is enhanced by increasing well productivity. The process of fracking, also known as induced hydraulic fracturing, involves mixing a formation proppant (e.g., sand) and chemicals in water to form a formation fracturing fluid (i.e., a fracturing fluid) and injecting the fracturing fluid at a high pressure through a wellbore into a subterranean formation. Small fractures are formed, allowing formation fluids (e.g., formation gas, petroleum, and brine water), to migrate into the wellbore for harvesting. Once the hydraulic pressure is reduced back to equilibrium, the sand or other formation proppant particles hold the fractures open.

Multi-stage hydraulic fracturing is an advancement that provides harvesting of fluids along a single wellbore or fracturing string. The fracturing string, usually for vertical or horizontal wellbores, passes through different geological zones. Some geological zones do not require harvesting, since desired natural resources are not located in those zones. These zones can be isolated so that no fracking action occurs in these zones that are empty of desired natural resources. Other zones having natural resources employ portions of the fracturing string to harvest these productive zones.

Instead of having to alternate between drilling deeper and fracturing operations, a system of fracking sleeves and packers can be installed within a wellbore to form the fracturing string in a multi-stage fracturing process. The sleeves and packers are positioned within zones of the wellbore. Fracking can be performed in stages by selectively activating sleeves and packers, thereby isolating particular subterranean zones. Each target zone can then be fracked stage by stage, for example, by sealing off selected zones, and perforating or fracturing without interruptions due to having to drill between each fracturing stage.

SUMMARY

The disclosure provides a wellbore fracturing system for a subterranean formation of a wellbore. In one example, the wellbore fracturing system includes: (1) wellbore fracturing resources coupled through a wellbore conveyance to the subterranean formation of the wellbore, (2) a bottom hole pressure gauge that provides a bottom hole gauge pressure, and (3) a processor coupled to the wellbore fracturing resources and the wellbore conveyance that calculates a wellbore friction pressure using a time-series sampling of bottom-hole gauge pressures for a fracturing fluid system after a uniform fracturing fluid condition is achieved in the wellbore.

The disclosure also provides a method of calculating a friction pressure (CALCFP) in a wellbore. In one example, this method includes: (1) determining a uniform fluid condition for a fracturing fluid in the wellbore, (2) sampling time-series bottom-hole gauge pressure data after the uniform fluid condition of the fracturing fluid is achieved, and (3) calculating a friction pressure for each sample of the time-series bottom-hole gauge pressure data.

The disclosure further provides a method of managing a friction pressure in a wellbore. In one example, the method of managing a friction pressure includes: (1) applying a fracturing fluid system to the wellbore, (2) sampling current fracturing job data, (3) calculating a friction pressure for the current fracturing job data, and (4) managing the fracturing fluid system to maintain the friction pressure within selected limits.

BRIEF DESCRIPTION

Reference is now made to the following descriptions taken in conjunction with the accompanying drawings, in which.

DETAILED DESCRIPTION

This disclosure addresses the problem of determining the friction pressure of a fracturing fluid system in a wellbore during hydraulic fracturing (in both real time and pre-job). This disclosure requires that at least one fracturing stage pumped using a hydraulic fracturing fluid system employ at least one bottom hole gauge pressure (BHGP) time-series measurement somewhere in the wellbore. Effects, such as the influence of source water on friction pressure, can be directly captured by this approach and used to select an optimal fracturing fluid system on location.

This disclosure applies to a hydraulic fracturing fluid system (here fracturing fluid system may refer to one or more combinations of fracturing fluids, proppants and chemicals) where data from at least one fracturing stage is available having a bottom-hole gauge pressure measurement. This disclosure proposes a use of BHGP measurements to determine friction pressure with and without proppant that may then be used to calibrate a chosen friction model with or without proppant, and also to provide scaling of laboratory data to field conditions. This calibrated friction model and/or scaled lab data may then be used to predict friction pressures for any future hydraulic fracturing stages that employ the fluid system under consideration. The accurate prediction of friction pressure can be used to design or select fluid systems to match target operating pressures, diagnose perforation and near-wellbore properties using step-down tests, thereby improving job design and determine pump maintenance and fuel costs for pumping a given fluid system.

The approach may also be used to vary a concentration of friction reducers and/or a type of friction reducers and/or a concentration and/or type of proppant over time (before/flush, during ramp-up, during stage, during ramp-down or after/flush of a wellbore) to determine fluid friction relationships that can be used to optimize treatment pressures in real time either during a current stage or from stage to stage. A real-time control algorithm may be included in the surface equipment control system where various step-up/step-down sequences may be introduced to automatically determine and differentiate fluid friction and proppant friction induced pressure drop. This information can proactively be used to model bottom-hole treating pressure, and select combinations of friction reducers, friction reducer concentration or proppant concentration or type to reach a target bottom-hole treating pressure in real time. The measured data can be shared with real-time models, and the modeled data can be used to determine operating set-points for fracture treatments in real time. A pressure response of the treatment can be measured enabling real-time fracture control and automation.

Figure 1:
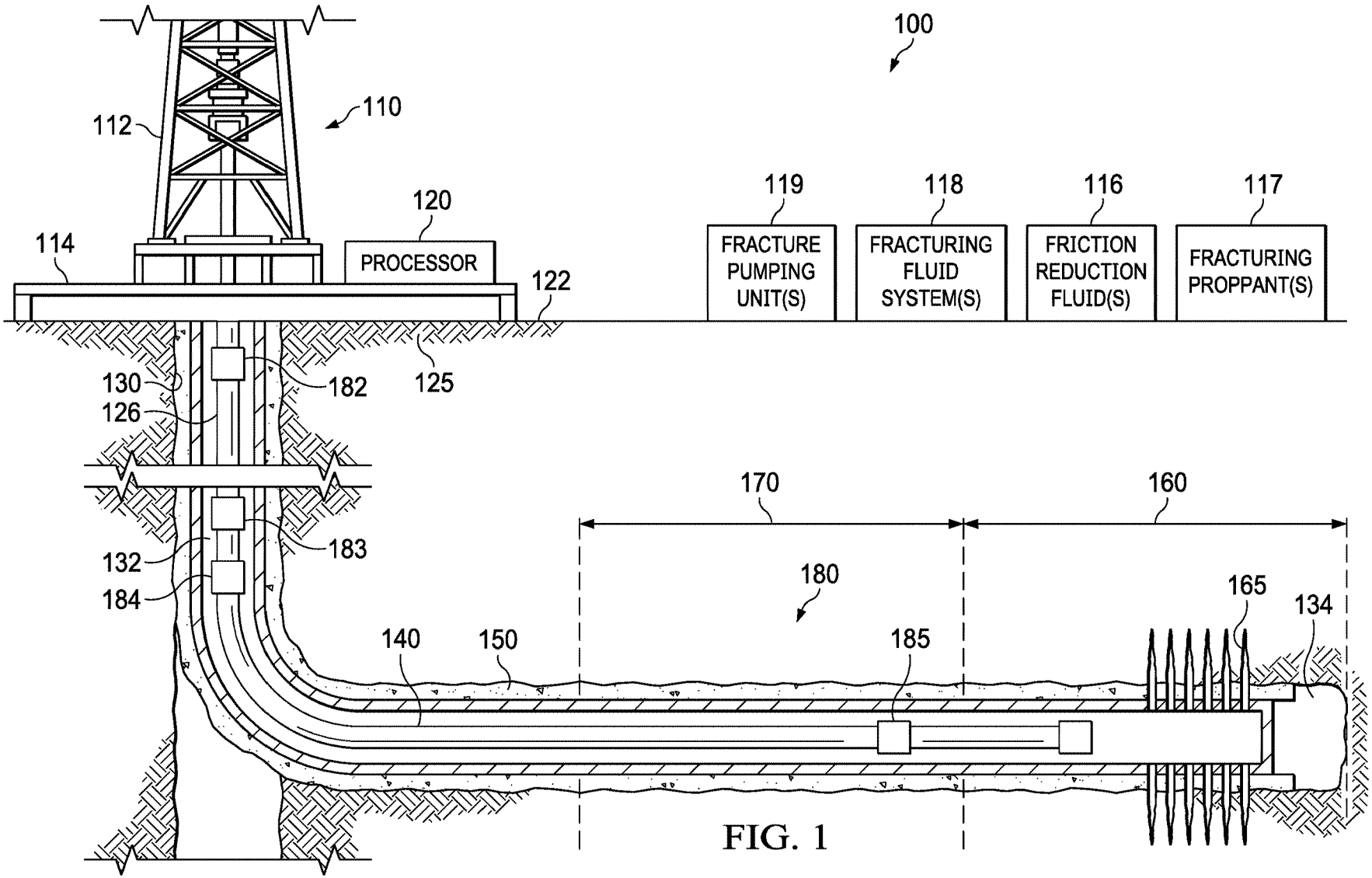
FIG. 1 illustrates a hydrocarbon wellbore fracturing system constructed according to the principles of this disclosure.

FIG. 1 illustrates a hydrocarbon wellbore fracturing system, generally designated 100, constructed according to the principles of this disclosure. The hydrocarbon wellbore fracturing system 100 provides an exemplary operating environment to discuss certain aspects of this disclosure wherein a horizontal, vertical, or deviated nature of any wellbore is not to be construed as limiting the disclosure to any particular wellbore configuration. As depicted, the hydrocarbon wellbore fracturing system 100 may suitably include a drilling rig 110 positioned on the earth's surface 122 and extending over and around a wellbore 130 penetrating a subterranean formation 125 for the purpose of primarily recovering hydrocarbons. The wellbore 130 may be drilled into the subterranean formation 125 using any suitable drilling technique. In one example, the drilling rig 110 includes a derrick 112 with a rig floor 114. The drilling rig 110 may be conventional and may include a motor driven winch or other associated equipment for extending a work string, or a casing string into the wellbore 130. The components of the hydrocarbon wellbore fracturing system 100 can be coupled together via conventional connections.

In one example, the wellbore 130 may extend substantially vertically away from the earth's surface 122 over a vertical wellbore portion 132, or may deviate at any angle from the earth's surface 122 over a deviated or horizontal wellbore portion 134. The wellbore 130 may include one or more deviated or horizontal wellbore portions 134. In alternative operating environments, portions or substantially all of the wellbore 130 may be vertical, deviated, horizontal or curved. The wellbore 130 includes a casing string 140. In the example of FIG. 1, the casing string 140 is secured into position in the subterranean formation 125 in a conventional manner using cement 150.

In accordance with the disclosure, the wellbore system 100 includes one or more fracturing zones. While only two fracturing zones (e.g., a lower fracturing zone 160 and upper fracturing zone 170) are illustrated in FIG. 1, and it is further illustrated that the two fracturing zones are located in a horizontal section 134 of the wellbore 130, it should be understood that the number of fracturing zones for a given well system 100 is almost limitless, and the location of the fracturing zones is not limited to horizontal portions 134 of the wellbore 130. In the embodiment of FIG. 1, the lower fracturing zone 160 has already been fractured, as illustrated by the fractures 165 therein. In contrast, the upper fracturing zone 170 has not been fractured, but in this embodiment is substantially ready for perforating and/or fracturing. Fracturing zones, such as those in FIG. 1, may vary is depth, length (e.g., 30-150 meters in certain situations), diameter, etc., and remain within the scope of the present disclosure. In the example of FIG. 1, a wellbore conveyance 126 does not employ a service tool assembly or a downhole tool. The wellbore conveyance 126 is outfitted to provide a fracturing fluid system to a target fracturing zone without use of the service tool assembly or downhole tool.

In another example, the wellbore system 100 may further include a downhole tool assembly, manufactured in accordance with this disclosure, and positioned in and around (e.g., in one embodiment at least partially between) the lower fracturing zone 160 and upper fracturing zone 170. Again, while the service tool assembly is positioned in a horizontal section 134 of the wellbore 130 in the embodiment of FIG. 1, other embodiments exist wherein the downhole tool assembly is positioned in a vertical 132 or a deviated section of the wellbore 130 and remain within the scope of the disclosure. In the embodiment of FIG. 1, the downhole tool assembly, with the assistance of other fracturing apparatuses (e.g., upper and lower zone packer assemblies), is configured to substantially if not completely isolate the upper fracturing zone 170 from the lower fracturing zone 160. By isolating the upper fracturing zone 170 from the lower fracturing zone 160 during the fracturing process, the upper fracturing zone 170 may be more easily perforated and/or fractured. Additionally, the isolation may protect the lower fracturing zone (and more particularly any fluid loss device of the lower fracturing zone 160) from the perforating and/or fracturing process. In accordance with the disclosure, the service tool assembly includes a lower packer assembly, as well as a packer plug positioned within the lower packer assembly. In accordance with the disclosure, the packer plug includes a check valve for allowing fluid to pass up-hole from the lower packer assembly and through the packer plug as the packer plug is being pushed downhole. A check valve, however, substantially prevents fluid from entering the lower packer assembly as the packer plug is being pulled up-hole.

The present disclosure has recognized that by including the check valve with the packer plug, any excess fluid existing between the packer plug and the lower packer assembly may exit the lower packer assembly as the packer plug is positioned therein. As no excess fluid exists between the packer plug and the lower packer assembly, the packer plug may physically rest upon a no-go shoulder of the lower packer assembly. Accordingly, when a perforating device is discharged up-hole of the packer plug during the fracturing process, any force created by a compression wave resulting therefrom will transfer directly between the packer plug and the lower packer assembly. Moreover, since the packer plug physically rests on the lower packer assembly, the force of the compression wave cannot compress the fluid located there between, and thus does not damage the fluid loss device located directly there below.

While the wellbore system 100 depicted in FIG. 1 illustrates a stationary drilling rig 110, one of ordinary skill in the art will readily appreciate that mobile workover rigs, wellbore servicing units (e.g., coiled tubing units), and the like may be similarly employed. Further, while the wellbore system 100 depicted in FIG. 1 refers to a wellbore penetrating the earth's surface on dry land, it should be understood that one or more of the apparatuses, systems or methods illustrated herein may alternatively be employed in other operational environments, such as within an offshore wellbore operational environment, for example, a wellbore penetrating a subterranean formation beneath a body of water. Although the wellbore system 100 provides examples of fracturing for a single wellbore, multiple wellbores may employ fracturing operations concurrently. These concurrent operations may employ a common source for fracturing resources such as friction reducing fluids and fracturing proppants, or they may be distributed to each wellbore or a subset of the total number of wellbores being fractured. Also, a multiple wellbore fracturing operation may employ a common central processor or divide wellbore processing among several processors. Additionally, a fracturing water quality analysis may be performed for a common water supply for a multiple wellbore operation, or may be performed individually for separate water supplies The hydrocarbon wellbore fracturing system 100 additionally includes surface equipment such as one or more pumping units 119 and wellbore fracturing resources such as friction fluids 116, fracturing proppants 117 and fracturing fluid systems 118 employing at least a portion of the friction fluids 116 and fracturing proppants 117. In the illustrated example, these fracturing fluid systems 118 are pumped, by the pumping units 119, through the wellbore conveyance 126. The wellbore conveyance 126 may be a drill pipe or another type of conveyance sufficient to handle the pressure used for fracturing. The hydrocarbon wellbore fracturing system 100 further includes wellbore pressure determining means such as pressure gauges. These pressure gauges may include a wellhead pressure gauge 182 that provides a surface wellhead pressure (WHP) and a bottom hole pressure gauge 185 that provides a bottom hole gauge pressure (BHGP) that is communicated to the surface 122.

Additionally included is at least one wellbore pressure gauge (in this example, WP1 through WPn pressure gauges are shown) that determines an intermediate wellbore pressure, which is communicated to the surface 122. These intermediate wellbore pressures may be employed to facilitate verification of a uniform fracturing fluid condition throughout the wellbore 130. In another example, electrical or optical sensors (not expressly shown) may be placed in an annular space between casing and formation where they are typically cemented in place. These sensors are communicatively coupled to an electrical or optical cable (not expressly shown) that is controlled by a processor 120 at the surface 122. The optical cable may include multiple optical fibers that may be used for distributed temperature sensing or distributed acoustic sensing.

The processor 120 additionally calculates a wellbore friction pressure for a selected fracturing fluid system and manages the fracturing fluid system to maintain the wellbore friction pressure within predetermined limits. This wellbore friction pressure may be employed to calibrate or update a friction model that may be employed in fracturing the wellbore 130. The processor 120 may employ or store executable programs of sequences of software instructions to perform one or more of various calculations including a wellbore friction pressure, updating a wellbore friction model or selecting various fracturing fluid systems, for example. The software instructions of such programs may represent algorithms and be encoded in machine-executable form on non-transitory digital data storage media, (e.g., magnetic or optical disks, random-access memory (RAM), magnetic hard disks, flash memories, and/or read-only memory (ROM)), to enable the processor 120 to perform one, multiple or all of the steps of one or more of the described methods, functions, systems or apparatuses described herein. Portions of disclosed examples may relate to computer storage products with a non-transitory computer-readable medium that have program code thereon for performing various computer-implemented operations that embody a part of an apparatus, device or carry out the steps of a method set forth herein.

Non-transitory used herein refers to all computer-readable media except for transitory, propagating signals. Examples of non-transitory computer-readable media include, but are not limited to: magnetic media such as hard disks, floppy disks, and magnetic tape as well as optical media such as CD-ROM disks; magneto-optical media in general and hardware devices that are specially configured to store and execute program code, such as ROM and RAM devices. Examples of program code include both machine code, such as that produced by a compiler, and files containing higher level code that may be executed by the computer using an interpreter.

If real-time BHGP data is available, the processor 120 can employ the methodology of this disclosure and can be utilized for real-time control and optimization of a fracturing fluid system, including selection of a friction reducer and proppant type and concentration. Note that the disclosed method or approach includes the use of multiple BHGP data if available, which will serve to enhance the accuracy of the real-time calculations and improve operational decisions.

The disclosed approach may also be used to vary the concentration of friction reducers and/or types of friction reducers as well as a concentration of proppant over time (before/flush, during ramp-up, during stage, during ramp-down, after/flush) to determine fluid friction relationships that can be used to optimize treatment pressures in real time either during a current fracturing stage or from stage to stage. A real-time control algorithm may be included in the processor 120 acting as a surface equipment control system, where various step-up/step-down sequences may be introduced to automatically determine and differentiate fluid friction and proppant friction induced pressure drop.

The disclosed approach can additionally be used to also distinguish between friction pressures inside the wellbore and in the near-wellbore region including formation perforations. An example application of this disclosure may be to evaluate an effectiveness of a diversion treatment. All of this information may proactively be used to model bottom-hole treating pressure, and select combinations of friction reducers or a friction reducer concentrations as well as a proppant concentration to reach a target bottom-hole treating pressure in real time. The measured data can be shared with real-time models, and the modeled data can be used to determine operating set-points for fracture treatments in real time. Additionally, the pressure response of a treatment can be measured enabling real-time fracture control and automation.

Figure 2:
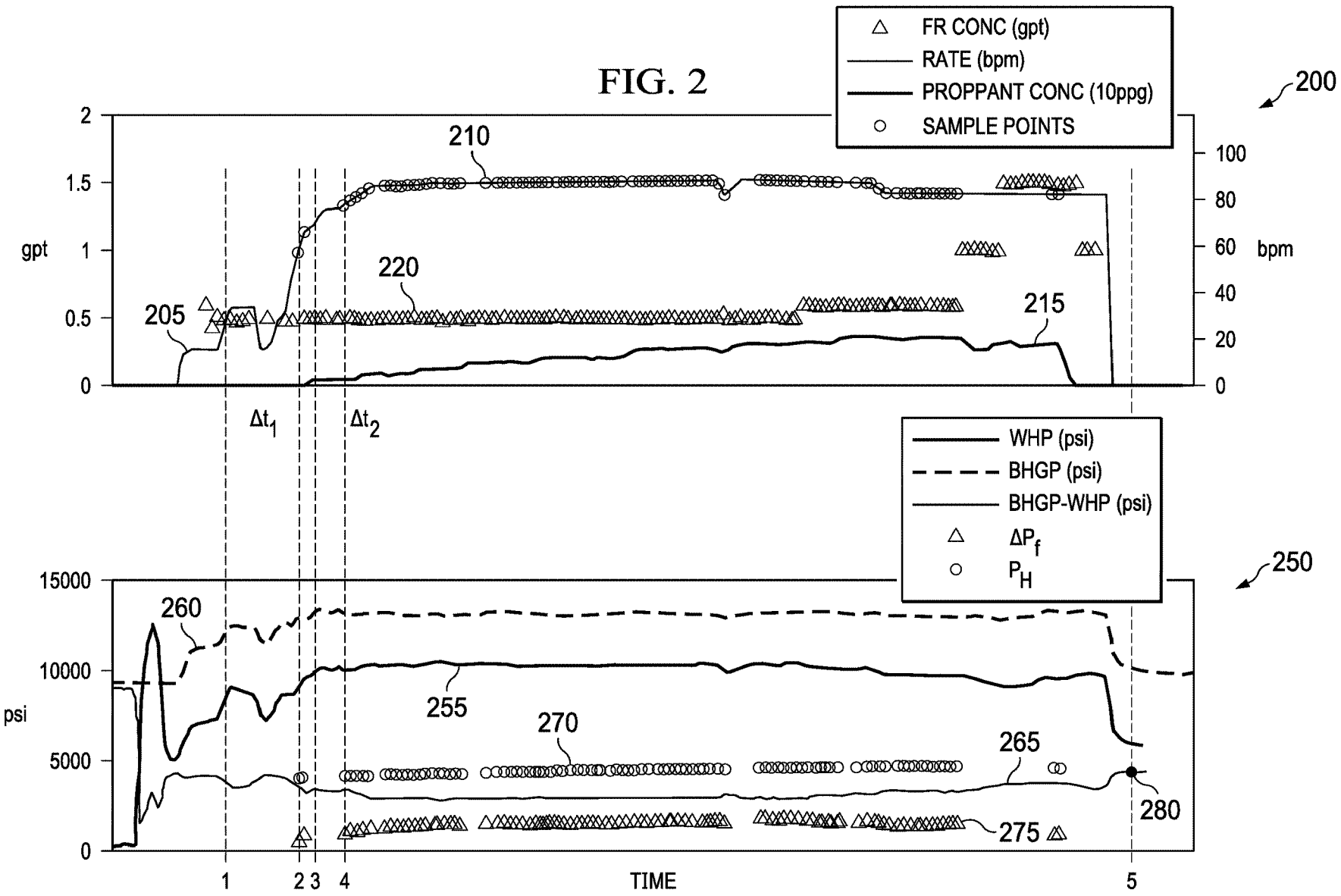
FIG. 2 illustrates an example of two fracturing treatment blocks constructed according to the principles of the disclosure.

FIG. 2 illustrates an example of two fracturing treatment blocks, generally designated 200, 250, constructed according to principles of the disclosure. These two sets of graphs are plotted over time and provide data for a wellbore friction pressure determination, a wellbore friction model calibration and updating and management of a wellbore friction in real time. Fracturing treatment block 200 depicts a fracturing fluid pumping rate 205 in barrels per minute (bpm) showing sample points 210, a fracturing fluid proppant concentration 215 of 10 pounds per gallon (ppg) of fracturing fluid and a friction fluid concentration 220 in gallons of friction fluid per thousand gallons of fracturing fluid (gpt). Fracturing treatment block 250 depicts a wellhead pressure (WHP) 255 in pounds per square inch (psi), a bottom hole gauge pressure (BHGP) 260 in psi, a wellbore differential pressure (BHGP-WHP) 265 in psi, a wellbore hydrostatic pressure

270 in psi at a bottom hole gauge pressure point location and a wellbore friction pressure 275 in psi.

Friction pressure may be determined from bottom hole gauge pressure for a particular stage from job data by obtaining sample points for calculating the friction pressure using a sweep method (or a sweep approach). For calculating the sample points in the sweep approach or method, it is required that the wellbore be filled with a fracturing fluid system having a uniform condition from the wellhead down to the position of the bottom hole gauge pressure. This uniform condition refers to uniformity in density, chemical composition of the fluid (such as a same concentration of friction reducing fluids), and proppant concentration in the fracturing fluid system. Note that if more than one downhole gauge pressure unit is installed in the wellbore, they can be used to verify the uniform condition, as well as a fully developed flow condition. The following procedure illustrates the use of the sweep approach or method to obtain the sample points.

Choose a target condition: say 0.5 gallons of friction reducer (FR1) per thousand gallons of water (fracturing fluid) that may be generally expressed as 0.5 gpt of friction reducer FR1. Start from a time when this concentration is first introduced and use a fracturing fluid flow rate to determine a first instance where a target fracturing fluid system is consistent from wellhead to the bottom hole gauge location. Then, $$\Delta t = \frac{\gamma(MD_{BHG} - MD_{WH})}{\overline{V}}, \tag{1}$$

where $MD_{BHG}$ is the measured depth at the bottom hole gauge location and $MD_{WH}$ is the measured depth at the well head. The quantity $\gamma$ is a factor that accounts for mixing and imperfect fluid displacement, and $\overline{V}$ is the average fluid velocity during that period of time.

In FIG. 1, line 1 indicates the starting point of this target and line 2 indicates the end point of a sweep, where $\Delta t_1$ is a first sweep interval after which sampling begins. The factor $\gamma$ is typically chosen to be greater than 1. Perfect fluid displacement without any mixing is represented by $\gamma=1$. If within this time interval the fluid condition deviates from the target condition then the calculations are stopped, the fluid system conditions are updated and a new starting sample point is searched. Once sampling starts, it is continued at every subsequent data point until the target condition no longer holds. At this point, the target condition is updated and a new starting sample point is obtained.

The target condition may also involve proppant concentration, for example, 0.5 gallons of Friction Reducer 1 per thousand gallons of water (fracturing fluid) and 0.25 pounds proppant concentration per gallon (ppg) of water (fracturing fluid) that may be expressed as 0.5 gpt FR1, 0.25 ppg proppant concentration. This condition is illustrated in FIG. 1, where line 3 is the starting point for this target, line 4 is the end point for this sweep, and $\Delta t_2$ is a second sweep interval after which sampling again begins.

In order to determine reliable sample points, some data processing may be necessary. Sometimes, data readings during operations can contain spurious noise such as in some data (e.g., FR concentration) that may have significant impact on the sample values. Passing the data through a low pass filter may provide more accurate sampling for these cases, for example. The density of the fluid pumped may be used to calculate the hydrostatic pressure which affects the calculation of friction pressure. A reliable estimate of fluid density can be obtained by sampling data points (e.g., sample data point 280) after the end of pumping (once a water hammer signature has subsided). This is indicated by line 5 in FIG. 2.

For each sample point, friction pressure drop may be calculated using equation (2) below.

$$\Delta P_f = WHP - BHGP + P_H, \tag{2}$$

where WHP is the well-head pressure, BHGP is the bottom hole gauge pressure and $P_H$ is the hydrostatic pressure at the bottom hole gauge location, given by:

$$P_H = \rho g(TVD_{BHG}), \tag{3}$$

where $\rho$ is the density of the fluid system at the target condition, g is the acceleration due to gravity and $TVD_{BHG}$ is the total vertical depth at the bottom-hole gauge location. All of these measured and calculated pressures are plotted in FIG. 1. The calculated value of $\Delta P_f$ may be used to calibrate the parameters of a friction model. A typical friction model $\Delta P_m$ for a fracturing fluid system may be written as:

$$\Delta P_m = f(V, A, \rho, n, k, W_e)\psi(\phi), \tag{4}$$

where f is a function of the flow velocity V, cross-sectional area A, density $\rho$, power-law index n, consistency index k, and fluid Weissenberg number We. The function $\psi$ accounts for the effect of a proppant concentration $\phi$ (expressed as a dimensionless volume fraction). Friction models are typically developed for certain representative fluids using extensive lab testing and validation. In order to apply them to new fracturing fluid systems, calibration of one or more model parameters is typically required. Setting $\Delta P_f = \Delta P_m$ provides for calibration of the model parameters. The function $\psi$ is a less well known effect, and the bottom-hole gauge pressure (BHGP) measurements allow the determination of $\psi(\phi)$ for particular fluid systems. Then, $$\frac{\Delta P_f(\phi)}{\Delta P_f(0)} = \frac{\Delta P_m(\phi)}{\Delta P_m(0)} = 1 + \alpha\phi, \tag{5}$$

where $\alpha$ is a model parameter to be determined from the data. Depending upon the fluid system in question, other types of models may be appropriate.

Another use of the calculated friction pressure is to scale lab measurements to meet actual field conditions. Very often, for a new fluid system, the only measurements available are from laboratory friction testing that is carried out on a much smaller scale than an actual field application. The calculated friction pressure may be used to obtain, validate or calibrate scaling relationships that allow the use of lab data for field applications.

A calibrated friction model and/or scaled lab data may be used to predict friction pressures for a fluid system at any given condition. An accurate prediction of friction in a wellbore may be utilized to design or select fluid systems to meet target operating pressures. Also, an accurate prediction of friction in a wellbore may be employed to diagnose perforation and near-wellbore properties using step-down tests to thereby improve fracturing job design. These properties may be input to a hydraulic fracturing simulator thereby providing accurate estimations that are valuable for high quality job designs. Additionally, pump maintenance and fuel costs for pumping a given fluid system may be determined.

Figure 3:
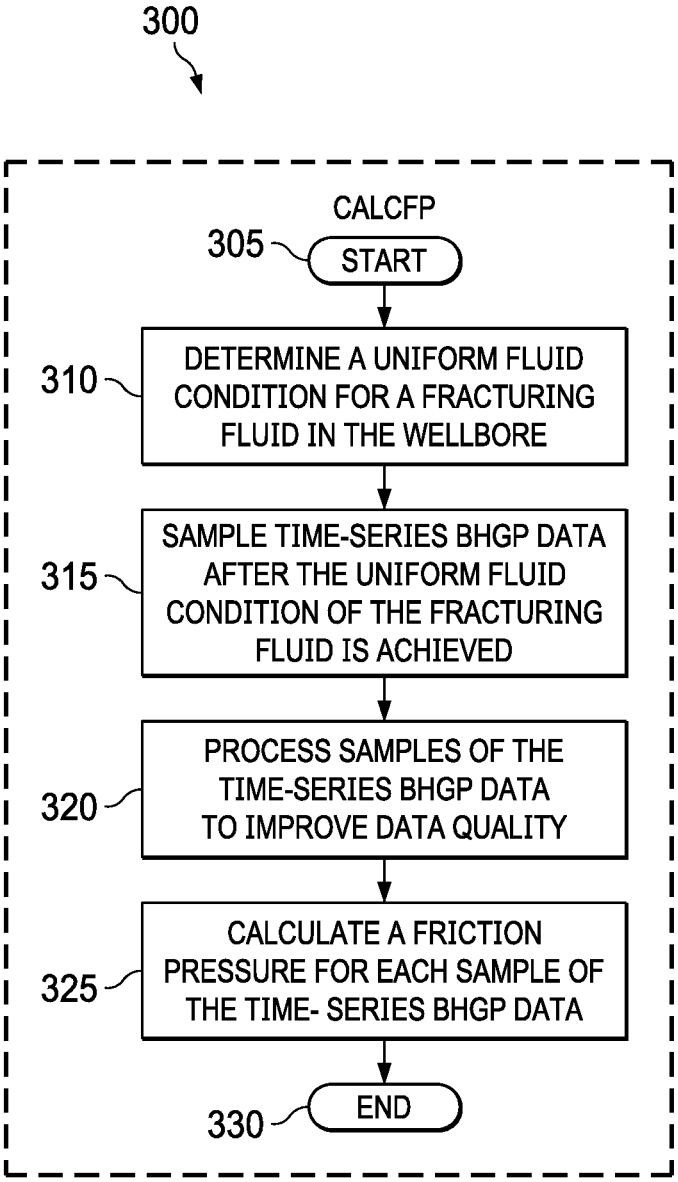
FIG. 3 illustrates a flowchart of an example of a method of calculating a friction pressure (CALFP) for a wellbore carried out according to the principles of the disclosure.

FIG. 3 illustrates a flowchart of an example of a method of calculating a friction pressure (CALFP) for a wellbore, generally designated 300, carried out according to the principles of the disclosure. The method 300 starts in a step 305, and in a step 310, a uniform fluid condition is provided for a fracturing fluid in the wellbore. Then, time-series BHGP data are sampled in the wellbore after the uniform fluid condition of the fracturing fluid is achieved, in a step 315. The samples of the time-series BHGP data are processed to improve data sample quality, in a step 320. This processing may generally include cleaning or filtering of the samples of the time-series BHGP data. A friction pressure is calculated for each sample of the time-series BHGP data, in a step 325. This calculated friction pressure may be employed for updating or calibrating a friction pressure model or scaling lab data to determine friction pressure in any hydraulic fracturing stage that uses a selected fluid system. The method 300 ends in a step 330.

Application of the method 300 allows real-time determination of a wellbore friction pressure drop as it relates to fracturing friction reducers and proppants. This allows real-time control of friction reducers (type and concentration) and proppants to proactively control the impact of a friction reducer and proppant related pressure drop with the objective of controlling the bottom hole treating pressure. This results in lower treatment pressure with associated cost reductions due to fuel, equipment wear and tear, maintenance, time on location and improved hydraulic fracturing treatments.

Figure 4:
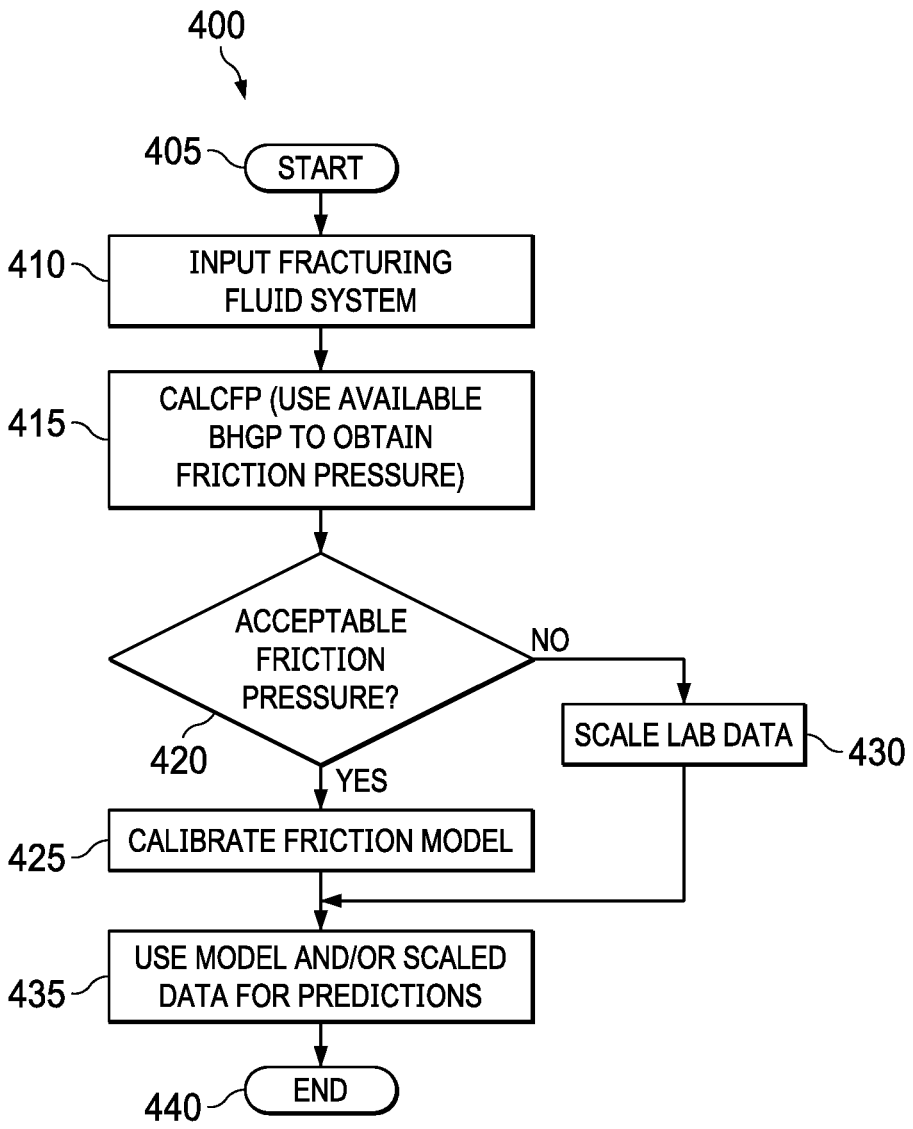
FIG. 4 illustrates a flowchart of an example of a method of predicting a wellbore friction pressure carried out according to the principles of the present disclosure.

FIG. 4 illustrates a flowchart of an example of a method of predicting a wellbore friction pressure, generally designated 400, carried out according to the principles of the present disclosure. The method starts in a step 405 and an input fracturing fluid system is provided in a step 410. A CALCFP method (as discussed with respect to FIG. 3) is employed in a step 415 to obtain one or more friction pressures for the fracturing fluid system applied in the step 410. In a decisional step 420, it is determined if the one or more friction pressures determined in the step 415 provide an acceptable friction pressure for a wellbore. If an acceptable friction pressure is indicated in the decisional step 420, it is employed to calibrate a friction model in a step 425 and the friction model is employed for wellbore friction fluid predictions in a step 435. If an unacceptable friction pressure is indicated in the decisional step 420, friction fluid lab data is scaled to provide current wellbore friction fluid predictions. The method 400 ends in a step 440.

Figure 5:
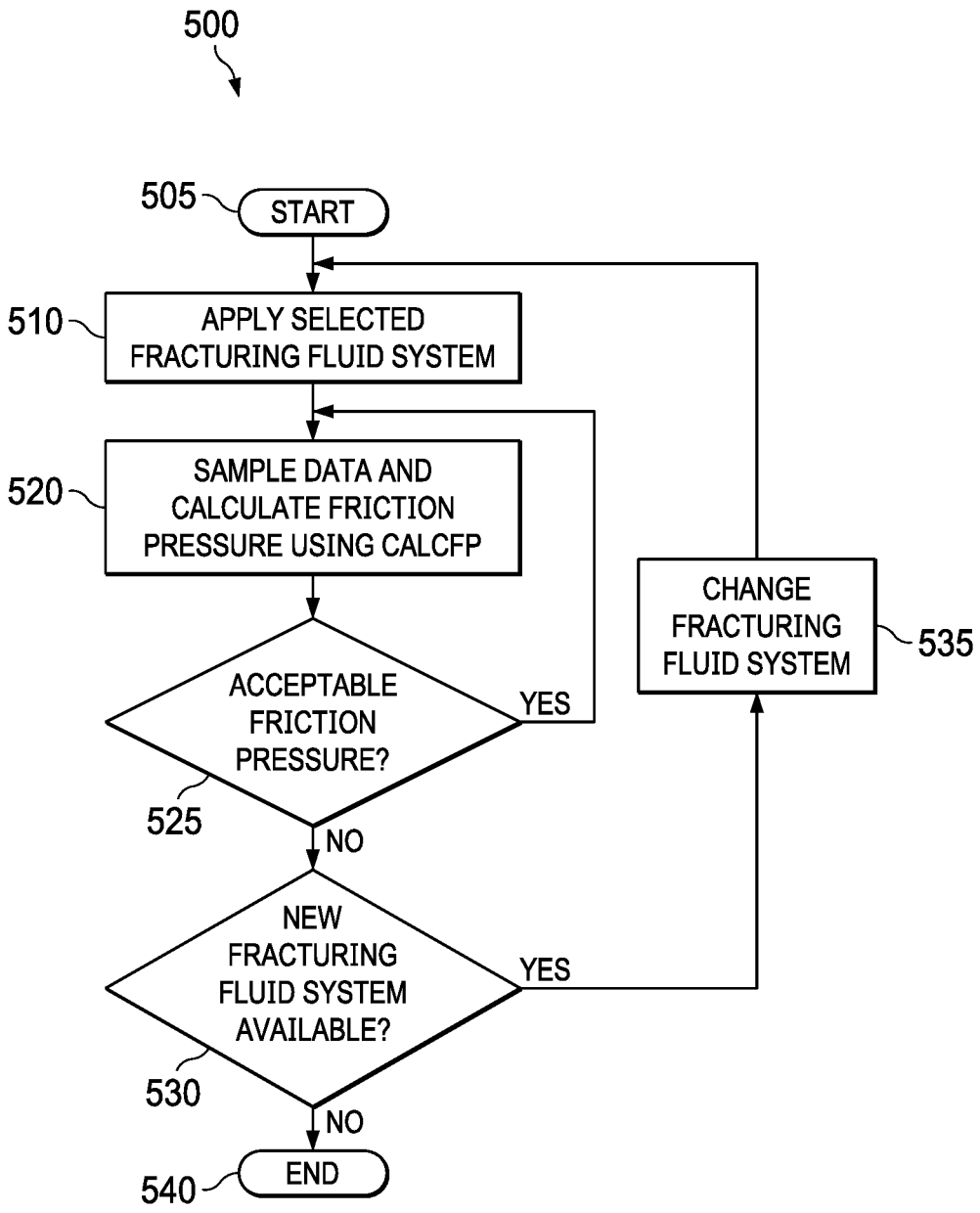
FIG. 5 illustrates a flowchart of an example of a method of managing a friction pressure in a wellbore carried out according to the principles of the disclosure.

FIG. 5 illustrates a flowchart of an example of managing a friction pressure in a wellbore, generally designated 500, carried out according to the principles of the disclosure. The method 500 starts in a step 505, and in a step 510, a selected fracturing fluid system is applied to the wellbore. Current fracturing job data is sampled in real time, in a step 520 and a friction pressure is calculated for the current fracturing job data employing a CALCFP method in a step 520 as discussed with respect to the method 300. If a decision step 525 determines that the friction pressure is acceptable, the method 500 returns to the step 520 where another sample of the current fracturing job data is taken. Then another friction pressure is calculated for this sample in the step 520 and this first processing loop continues as long as the decision step 525 determines that the calculated friction pressure of the step 520 is acceptable.

If the decision step 525 determines that the fluid pressure calculated in the step 520 is not acceptable, another decisional step 530 determines if a new fracturing fluid system is available. If a new fracturing fluid system is available, a need to change the existing fluid system is recognized in a step 535 and method 500 returns to the step 510 where a newly selected fracturing fluid system is applied to the wellbore. New fracturing job data is sampled in real time, and a friction pressure is calculated for the new fracturing job data, in the step 520. This second processing loop continues until the decision step 525 determines that a calculated friction pressure is acceptable, where the method 500 again employs the first processing loop, as before.

In one example, the current fracturing job data corresponds to bottom-hole gauge pressures. In another example, calculating the friction pressure employs CALCFP, as noted. In yet another example, a concentration or a type of a friction reduction fluid is changed to provide an acceptable friction pressure. In still another example, a concentration or type of fracturing fluid proppant is changed to provide an acceptable friction pressure. The method 500 ends in a step 540.

While the methods disclosed herein have been described and shown with reference to particular steps performed in a particular order, it will be understood that these steps may be combined, subdivided, or reordered to form an equivalent method without departing from the teachings of the present disclosure. Accordingly, unless specifically indicated herein, the order or the grouping of the steps is not a limitation of the present disclosure.

The description and drawings included herein are intended to illustrate the principles of the present disclosure. It will thus be appreciated that those skilled in the art will be able to devise various arrangements that, although not explicitly described or shown herein, embody the principles of the disclosure and are included within its scope. Furthermore, all examples recited herein are principally intended expressly to be for pedagogical purposes to aid the reader in understanding the principles of the disclosure and concepts contributed by the inventor to furthering the art, and are to be construed as being without limitation to such specifically recited examples and conditions. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated. Furthermore, directional terms, such as "above", "below", "upper", "lower", etc., are used only for convenience in referring to the accompanying drawings. Additionally, it is to be understood that the different embodiments of the present disclosure may be utilized in various orientations, such as inclined, inverted, horizontal, vertical, etc., and in various configurations, without departing from the principles of the present disclosure.

Those skilled in the art to which this application relates will appreciate that other and further additions, deletions, substitutions and modifications may be made to the described embodiments.

Various aspects of the disclosure can be claimed including apparatuses, systems and workflows as disclosed herein. Aspects disclosed herein include:

A. A wellbore fracturing system for a subterranean formation of a wellbore, including: (1) wellbore fracturing resources coupled through a wellbore conveyance to the subterranean formation of the wellbore, (2) a bottom hole pressure gauge that provides a bottom hole gauge pressure, and (3) a processor coupled to the wellbore fracturing resources and the wellbore conveyance that calculates a wellbore friction pressure using a time-series sampling of bottom-hole gauge pressures for a fracturing fluid system after a uniform fracturing fluid condition is achieved in the wellbore.

B. A method of calculating a friction pressure (CALCFP) in a wellbore, including (1) determining a uniform fluid condition for a fracturing fluid in the wellbore, (2) sampling time-series bottom-hole gauge pressure data after the uniform fluid condition of the fracturing fluid is achieved, and (3) calculating a friction pressure for each sample of the time-series bottom-hole gauge pressure data.

C. A method of managing a friction pressure in a wellbore including (1) applying a fracturing fluid system to the wellbore, (2) sampling current fracturing job data, (3) calculating a friction pressure for the current fracturing job data, and (4) managing the fracturing fluid system to maintain the friction pressure within selected limits.

Each of aspects A, B and C can have one or more of the following additional elements in combination:

Element 1: wherein the fracturing fluid system is managed to maintain the wellbore friction pressure within selected limits and at variable fracturing fluid flow rates. Element 2: wherein the fracturing fluid system is managed by the processor in real time. Element 3: wherein the processor calculates a friction pressure for each time-series sampling of the bottom-hole gauge pressure. Element 4: wherein the time-series sampling of bottom-hole gauge pressures employs a CALCFP method of obtaining the time-series sampling and calculating the wellbore friction pressure. Element 5: wherein the fracturing fluid system includes a friction reduction fluid or a fracturing proppant, each at selectable concentrations. Element 6: further comprising a wellhead pressure gauge that provides a wellhead pressure measurement. Element 7: further comprising at least one wellbore pressure gauge corresponding to an intermediate wellbore depth to determine the uniform fracturing fluid condition. Element 8: wherein the processor controls at least one fracture pumping unit to maintain the wellbore friction pressure within selected limits. Element 9: further comprising processing samples of the time-series bottom-hole gauge pressure data to improve data sample quality before calculating the friction pressure. Element 10: further comprising updating a friction pressure model using the friction pressure calculated for at least one time-series bottom-hole gauge pressure data sample. Element 11: wherein managing the fracturing fluid system includes maintaining the friction pressure within the selected limits in real time. Element 12: wherein the current fracturing job data corresponds to a bottom-hole gauge pressure. Element 13: wherein calculating the friction pressure employs a CALCFP method. Element 14: further comprising updating a friction model to reflect a current friction pressure of one or more current fracturing job data samples. Element 15: wherein an updated friction model or field-scaled lab data is used to predict a friction pressure. Element 16: wherein managing the fracturing fluid system includes changing a friction reduction fluid concentration or a type of friction reduction fluid for the wellbore. Element 17: wherein managing the fracturing fluid system includes changing a fracturing fluid proppant concentration or a type of fracturing fluid proppant for the wellbore. Element 18: wherein managing the fracturing fluid system includes managing a fracturing fluid injection rate for the wellbore.

What is claimed is:

1. A wellbore fracturing system for a subterranean formation of a wellbore, comprising:

wellbore fracturing resources coupled through a wellbore conveyance to the subterranean formation of the wellbore;

a bottom hole pressure gauge that provides a bottom hole gauge pressure; and a processor coupled to the wellbore fracturing resources and the wellbore conveyance that calculates a wellbore friction pressure using a time-series sampling of bottom-hole gauge pressures for a fracturing fluid system after a uniform fracturing fluid condition is achieved in the wellbore, wherein the uniform fracturing fluid condition is based on a uniformity of a density, a chemical composition, and a proppant concentration of a fracturing fluid in the wellbore.

2. The system as recited in claim 1 wherein the fracturing fluid system is managed to maintain the wellbore friction pressure within selected limits and at variable fracturing fluid flow rates.

3. The system as recited in claim 1 wherein the processor calculates the wellbore friction pressure using the time-series sampling of bottom-hole gauge pressures in real time.

4. The system as recited in claim 1 wherein the processor calculates a friction pressure for each time-series sampling of the bottom-hole gauge pressure.

5. The system as recited in claim 1 wherein the time-series sampling of bottom-hole gauge pressures employs a calculating a friction pressure (CALCFP) method of obtaining the time-series sampling and calculating the wellbore friction pressure.

6. The system as recited in claim 1 wherein the fracturing fluid system includes a friction reduction fluid or a fracturing proppant, each at selectable concentrations.

7. The system as recited in claim 1 further comprising a wellhead pressure gauge at a wellhead of the system that provides a wellhead pressure measurement.

8. The system as recited in claim 7 further comprising at least one wellbore pressure gauge that corresponds to an intermediate wellbore depth and is a different gauge than the bottom hole pressure gauge, wherein the wellhead pressure gauge, the at least one wellbore pressure gauge, and the bottom hole pressure gauge are used to determine the uniform fracturing fluid condition from the wellhead to the bottom hole pressure gauge in the wellbore.

9. The system as recited in claim 1 wherein the processor controls at least one fracture pumping unit to maintain the wellbore friction pressure within selected limits.

10. A method of calculating a friction pressure (CALCFP) in a wellbore, comprising:

determining a uniform fluid condition for a fracturing fluid in the wellbore using a flow rate of the fracturing fluid into the wellbore, a concentration of a proppant or a chemical in the fracturing fluid, and dimensions of the wellbore;

sampling time-series bottom-hole gauge pressure data after the uniform fluid condition of the fracturing fluid is achieved; and calculating a friction pressure for each sample of the time-series bottom-hole gauge pressure data.

11. The method as recited in claim 10 further comprising processing samples of the time-series bottom-hole gauge pressure data to improve data sample quality before calculating the friction pressure.

12. The method as recited in claim 10 further comprising updating a friction pressure model using the friction pressure calculated for at least one time-series bottom-hole gauge pressure data sample.

13. A method of managing a friction pressure in a wellbore, comprising:

applying a fracturing fluid system to the wellbore;

obtaining measurements from a wellhead pressure gauge and a bottom hole pressure gauge of the wellbore;

determining a uniform fluid condition for a fracturing fluid in the wellbore using the measurements from the wellhead pressure gauge and the bottom hole pressure gauge of the wellbore;

sampling current fracturing job data after the uniform fluid condition of the fracturing fluid is achieved;

calculating a friction pressure for the current fracturing job data; and managing the fracturing fluid system to maintain the friction pressure within selected limits.

14. The method as recited in claim 13 wherein managing the fracturing fluid system includes maintaining the friction pressure within the selected limits in real time.

15. The method as recited in claim 13 further comprising obtaining measurements from at least one intermediate pressure gauge, wherein determining the uniform fluid condition further includes using the measurements from the intermediate pressure gauge and the current fracturing job data corresponds to a bottom-hole gauge pressure from the bottom hole pressure gauge.

16. The method as recited in claim 13 wherein calculating the friction pressure employs a calculating a friction pressure (CALCFP) method.

17. The method as recited in claim 13 further comprising updating a friction model to reflect a current friction pressure of one or more current fracturing job data samples.

18. The method as recited in claim 13 wherein an updated friction model or field-scaled lab data is used to predict a friction pressure.

19. The method as recited in claim 13 wherein managing the fracturing fluid system includes changing a friction reduction fluid concentration or a type of friction reduction fluid for the wellbore.

20. The method as recited in claim 13 wherein managing the fracturing fluid system includes changing a fracturing fluid proppant concentration or a type of fracturing fluid proppant for the wellbore.

21. The method as recited in claim 13 wherein managing the fracturing fluid system includes managing a fracturing fluid injection rate for the wellbore.

* * * * *